US012041986B1

(12) United States Patent
Covington et al.

(10) Patent No.: US 12,041,986 B1
(45) Date of Patent: Jul. 23, 2024

(54) KNITTED FACE MASK

(71) Applicant: Easy Masks, L.L.C., Apex, NC (US)

(72) Inventors: Tyler Covington, Apex, NC (US); William T. Lawson, Apex, NC (US); Clifford D. Caddell, Apex, NC (US)

(73) Assignees: Tyler Covington, Alex, NC (US); William T. Lawson, Alex, NC (US); Clifford D. Caddell, Alex, NC (US)

( * ) Notice: Subject to any disclaimer, the term of this patent is extended or adjusted under 35 U.S.C. 154(b) by 157 days.

(21) Appl. No.: 17/308,164

(22) Filed: May 5, 2021

Related U.S. Application Data

(60) Provisional application No. 63/020,388, filed on May 5, 2020.

(51) Int. Cl.
*A41D 13/11* (2006.01)
*D04B 1/24* (2006.01)

(52) U.S. Cl.
CPC ..... *A41D 13/11* (2013.01); *A41D 13/1161* (2013.01); *D04B 1/24* (2013.01); *D10B 2501/042* (2013.01)

(58) Field of Classification Search
CPC ..... A41D 13/11; A41D 13/1161; D10B 2501/042; D04B 1/24
USPC ..... 2/9
See application file for complete search history.

(56) References Cited

U.S. PATENT DOCUMENTS

| | | | | |
|---|---|---|---|---|
| 6,116,236 | A * | 9/2000 | Wyss | A61F 5/08 128/200.24 |
| 7,846,145 | B2 | 12/2010 | Carstens | |
| 11,064,744 | B1 * | 7/2021 | Palacios | A41D 13/1107 |
| 11,064,745 | B1 * | 7/2021 | Ahmed | A41D 13/1123 |
| 11,083,231 | B1 * | 8/2021 | Lewis | A41D 13/1176 |
| 11,457,677 | B2 * | 10/2022 | Sun | A41D 13/1161 |
| 2015/0216241 | A1 * | 8/2015 | Lee | A41D 13/1192 128/863 |
| 2017/0013894 | A1 * | 1/2017 | Lee | A41D 13/11 |
| 2021/0307422 | A1 * | 10/2021 | Dion | A41D 13/1161 |
| 2022/0007756 | A1 * | 1/2022 | Chan | A41D 13/1107 |
| 2022/0062671 | A1 * | 3/2022 | Kanyikirize | A41D 13/1107 |

FOREIGN PATENT DOCUMENTS

TW 201601798 A 1/2016

* cited by examiner

*Primary Examiner* — Khaled Annis
*Assistant Examiner* — Dakota Marin
(74) *Attorney, Agent, or Firm* — MacCord Mason PLLC

(57) ABSTRACT

A face mask, face mask system, kit, and methods are shown and described. In one embodiment a face mask may be a knitted face mask. The face mask may be a dual layer face mask including an opening between the dual layers. The face mask may be a knitted, no-sew face mask. The face mask may include a discardable filter.

16 Claims, 10 Drawing Sheets

TABLE 1

Table 1 provides detailed test results of average sample pressure drop, particle penetration, and particle filtration efficiency at 0.3 - 0.4 μm.

TABLE 2

Table 2. Average particle filtration efficiency results

KNITTED FACE MASK

This application claims the benefit of U.S. provisional application No. 63/020,388, filed May 5, 2020, which is incorporated herein by reference in its entirety.

FIELD OF THE TECHNOLOGY

The present disclosure relates generally to face masks, and more particularly to improved knitted face masks, kits, assemblies, and methods.

BACKGROUND

In the current climate dealing with viral spread and highly contagious pathogens, a challenge has emerged with regard to personal protective equipment (PPE). PPEs are in short supply and high demand, and the necessarily high usage of the PPE equipment by the front line medical workers has impacted the ability of the general public to acquire PPEs.

In particular, protective masks, are in high demand. The mask shortage is partly due to the inability to reuse traditional masks, the difficulty and time consuming task of production of many of the reusable masks conventionally known, and/or cost of production.

Another challenge with conventional masks is the requirement to wear the mask for extended periods of time and the one size fits all, ill-fit and rigidity of the masks, making indentations and lacerations on the skin. Also challenging is that many people feel smothered by the traditional masks that may allow very little breathability through the mask, and/or, users find the masks difficult to use.

Applicant's desire to provide rapidly produced, effective, user-friendly, comfortable, and cost efficient face masks that provide a layer of protection against pathogen transmission. It is to these and other challenges that the disclosure of the present application is directed.

SUMMARY

In accordance with the present disclosure, face masks, face mask systems, kits and methods therefore are shown and described. A face mask in one embodiment may include a knitted front portion and a knitted back portion. The knitted front portion and knitted back portion forming a dual layer mask having an opening formed by the front portion and the back portion. The face mask may include a body, a set of trim sections, and a set of securing ends.

The mask may be a continuously knitted mask. The mask may be formed as a knitted blank and the front portion and the back portion joined to form an inside mask surface, an outside mask surface, and an opening formed within the inside mask surface. The opening may be a continuous opening, spanning from one end of the mask to the opposite end of the mask. The opening may be defined by the inside surface of the mask. The opening may be substantially the same height and length along the entire surface area of the opening within the inside surface. The mask may be a no-sew mask, being fully knitted and requiring no sewing.

The mask may include a tunnel. The mask may include a nose bridge. The nose bridge may be a flexible, formable nose bridge. The nose bridge may be a removable nose bridge.

The mask may include a top tuck stitch. The mask may include a bottom tuck stitch. The tuck stitches may collectively form a pocket. The pocket may be adapted to provide a breathable a breathable space between the mask and the user around the nose and mouth of the user.

The mask may, in some examples, include a set of seams toward each end of the mask. The seams may be formed of and/or include a melt yarn. The seams may be melt seams.

The mask may include a set of securing ends. Each end of the set of securing ends may include an ear loop formed from a cutout of one of the front or back knitted portions.

The mask may include an insert. The insert may be removable. The insert may be accommodated by the opening. The insert may be, in one example, a disposable, removable filter. The insert may include a body and two trim ends.

The inventions of the present disclosure may be considered methods for a face mask, systems for a face mask, and/or kits for a face mask according to any of the embodiment disclosed herein.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
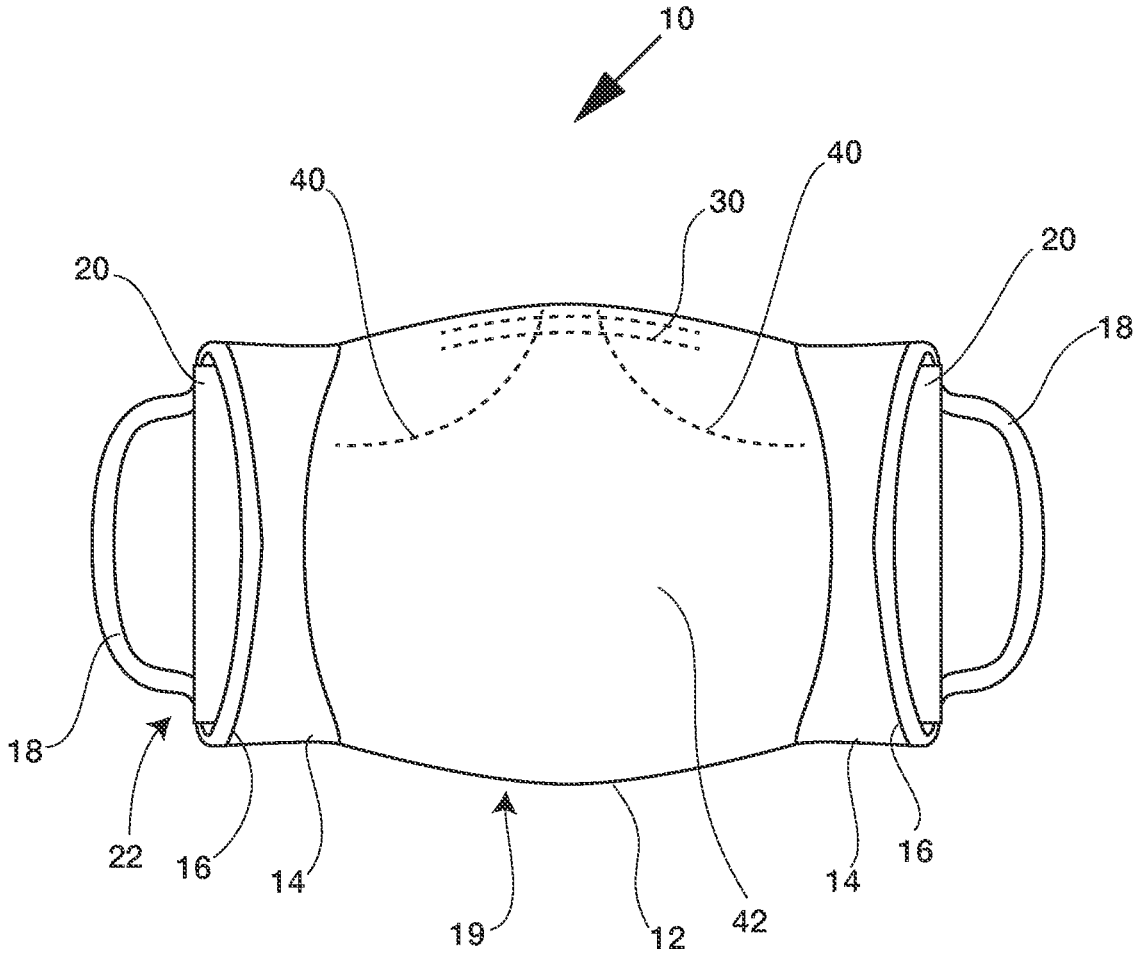
FIG. 1 is an inside surface view of one embodiment of a face mask according to the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto.

Figure 2:
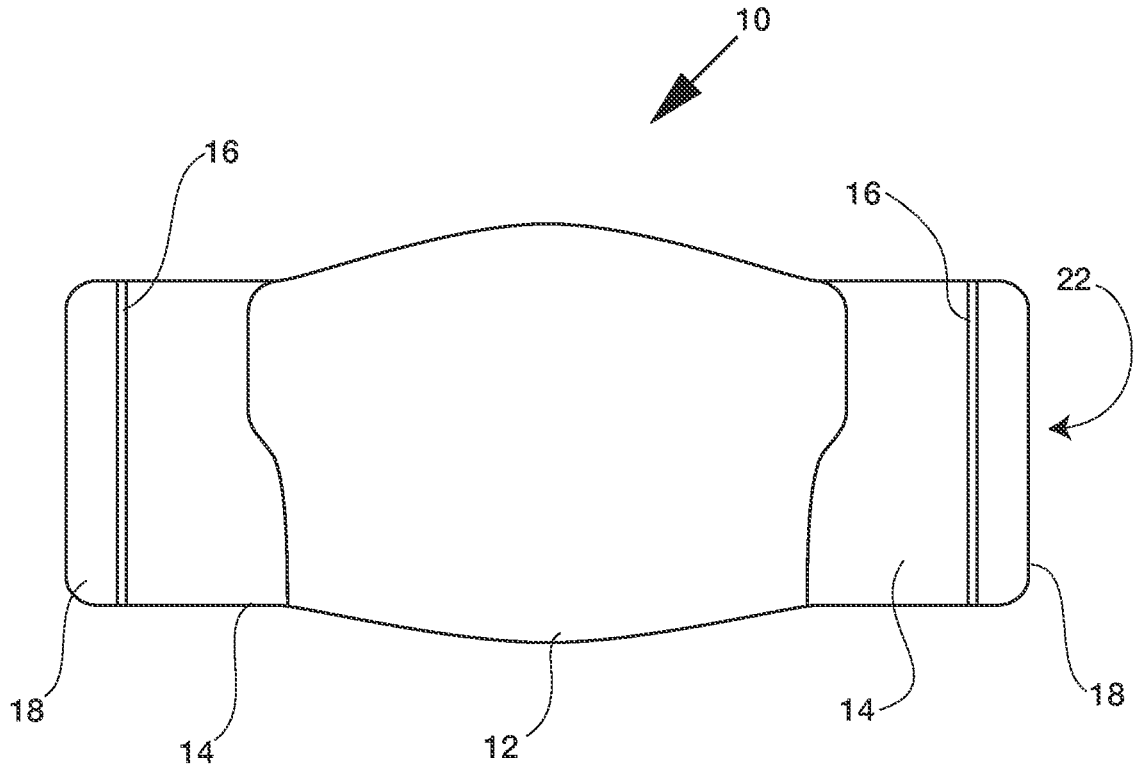
FIG. 2 shows another example of a face mask according to the disclosure.
Figure 3:
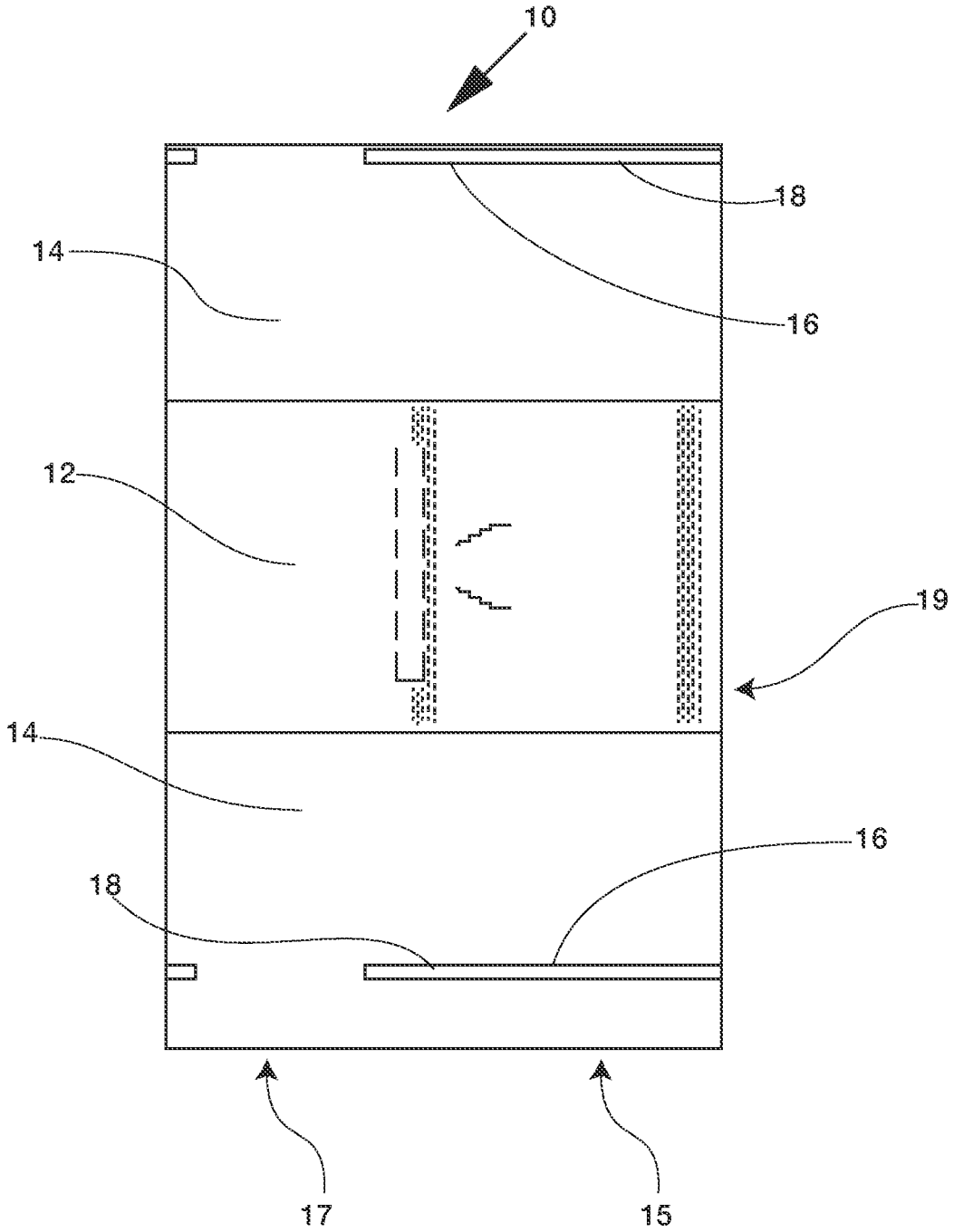
FIG. 3 shows one example of a blank for forming a face mask according to the disclosure.

FIGS. 1-3 introduce examples of a face mask 10 including a body 12, a trim 14 along each end of the body, and securing ends 18 at each end of the mask 10. The face mask 10 may be a knitted face mask. The knitted face mask 10 may be a dual layer face mask. An opening 22 may be formed between the dual layers of the face mask 10. An insert 20 may be accommodated by the opening 22.

In a knitted mask a variety of yarns may be used. The face mask 10 may be manufacture on knitting machines of any cylinder size and needle count. In some embodiments, each mask may require less than about 3 minutes of knitting time for production. By way of example, a suitable yarn may include cotton, hemp, wool, acrylic, tencel, viscose, polypropylene, polyester, nylon, and Spandex/Lycra, and/or yarn combinations thereof. Yarns may be embedded with antimicrobial and/or antiviral properties, for example, copper formulation and/or silver formulations.

The body 12 may be knit and may, for example, be a combination of cushion and non-cushion. The body 12, in certain embodiments using 200-needle machines, may be constructed with 2/70/72 micro-denier polyester and/or nylon. Using 144-needle machines, the body 12, in other embodiments, may be constructed with 3/70/72 micro-denier polyester and/or nylon.

The trim 14, in certain examples using 200 needle machines, may be constructed with two ends of 30-1/70 nylon spandex. In certain examples using a 144-needle machine, the trim 14 be constructed with two ends of 40-1-70 nylon spandex. In some examples, the trim 14 may include a welt. A welt may contain a laid in elastic, by way of example, 120 den double covered with 40 den nylon. The welt may be knit using Morpul to accomplish a loose stitch, and in some examples the loosest stitch possible. In some examples, before or after the welts, a melt yarn may be included for a seam 16 with melt yarn spliced in for a couple of courses with, for example, a nylon spandex, with a melt yarn only for 2 courses, followed by a couple courses again with a nylon spandex.

In some examples, the face mask 10 may include a seam 16 toward each end of the face mask. The seam 16 may be between the body 12 and trim 14. The seam, in other examples, may be within the trim 14. The seam 16 may, in some examples, be a melt seam. The seam 16 may include melt yarn. A melt yarn seam may prevent fraying toward the end of the mask. One example of a melt yarn is a thermo soluble melt yarn. The melt yarn may be knit across the securing end 18. In one embodiment, a melt yarn circumference percentage may range from 50% to 75%, and in some embodiments from 60% to 65%, and specifically in some examples around 62%. By way of example, a suitable denier of low temperature to high temperature melt yarn may be 110 dtex to 167 dtex. The melt yarn may be melted with the yarn during the boarding process, for example, at 250 degrees F. with a dwell time of around 3 seconds in a steam chamber and about 7.5 seconds in a heat chamber. In other examples, it may be preferable to not board the masks, and in certain instances a hot water-based scouring or dyeing process may be incorporated to melt the melt yarn, for example at 180-200 degrees F. for ten or more minutes.

Securing ends 18 may form ear loops for holding the face mask 10 on a user's face in use. In some examples, thicker securing ends 18 may form ear loops constructed using two-layer construction with welts, and in other examples, thinner ear loops may be constructed without welts by way of single-layer construction and being more elastic in nature with a thinner profile and increased comfort.

Figure 4:
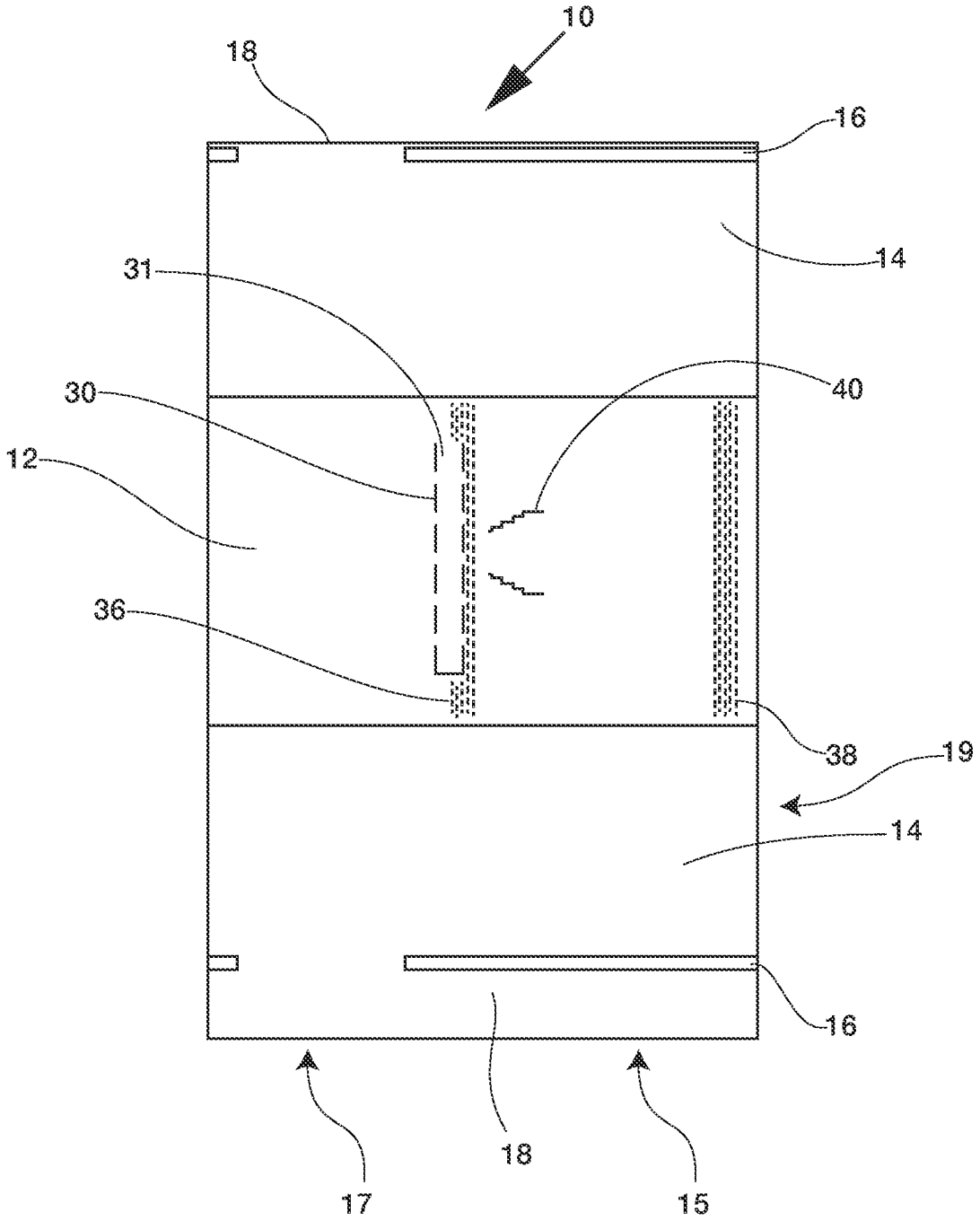
FIG. 4 shows examples of more details of a blank for forming a face mask according to FIG. 3.
Figure 5:
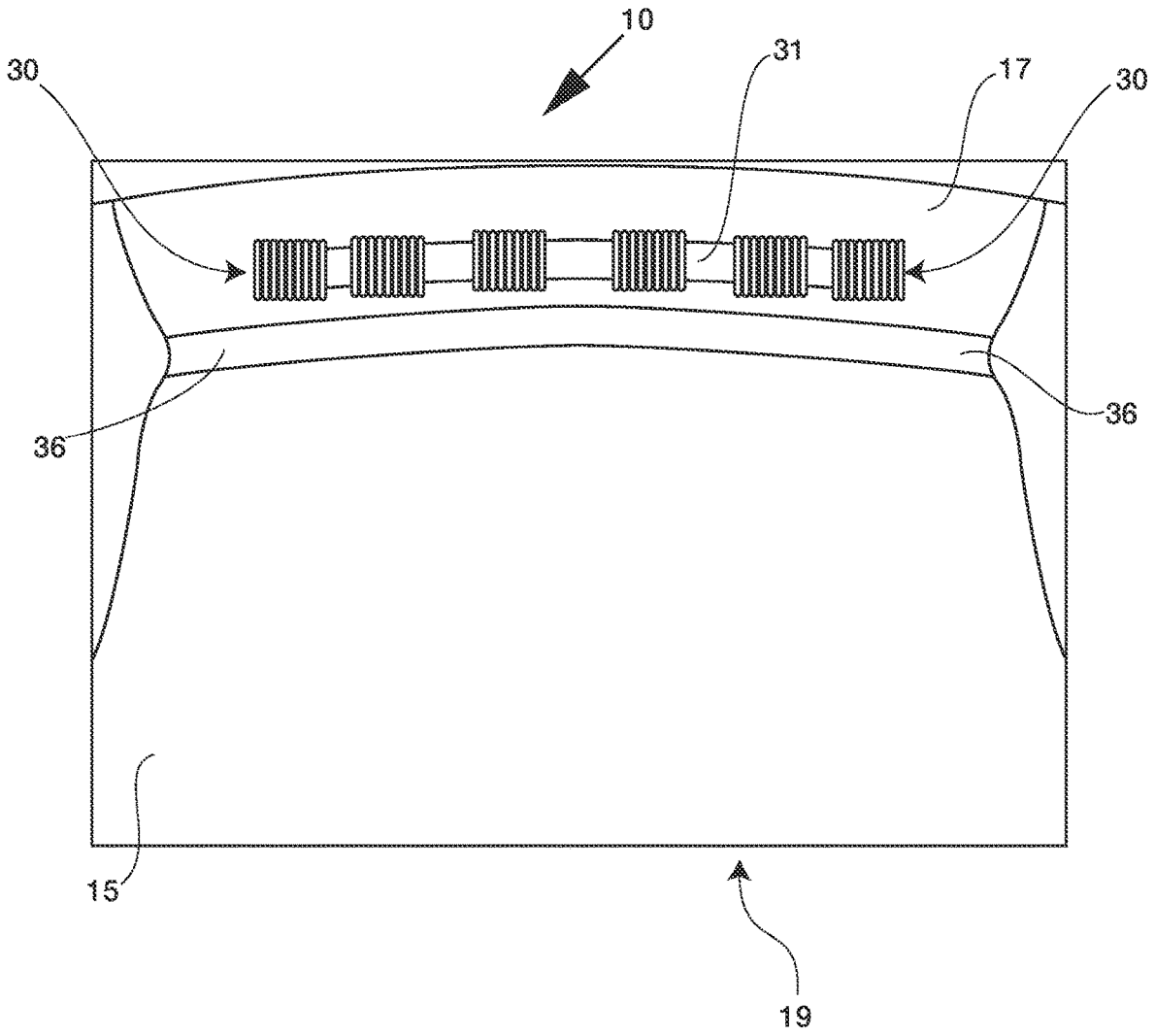
FIG. 5 is shows an inside surface enlarged view of one example of a face mask according to the disclosure.
Figure 6A:
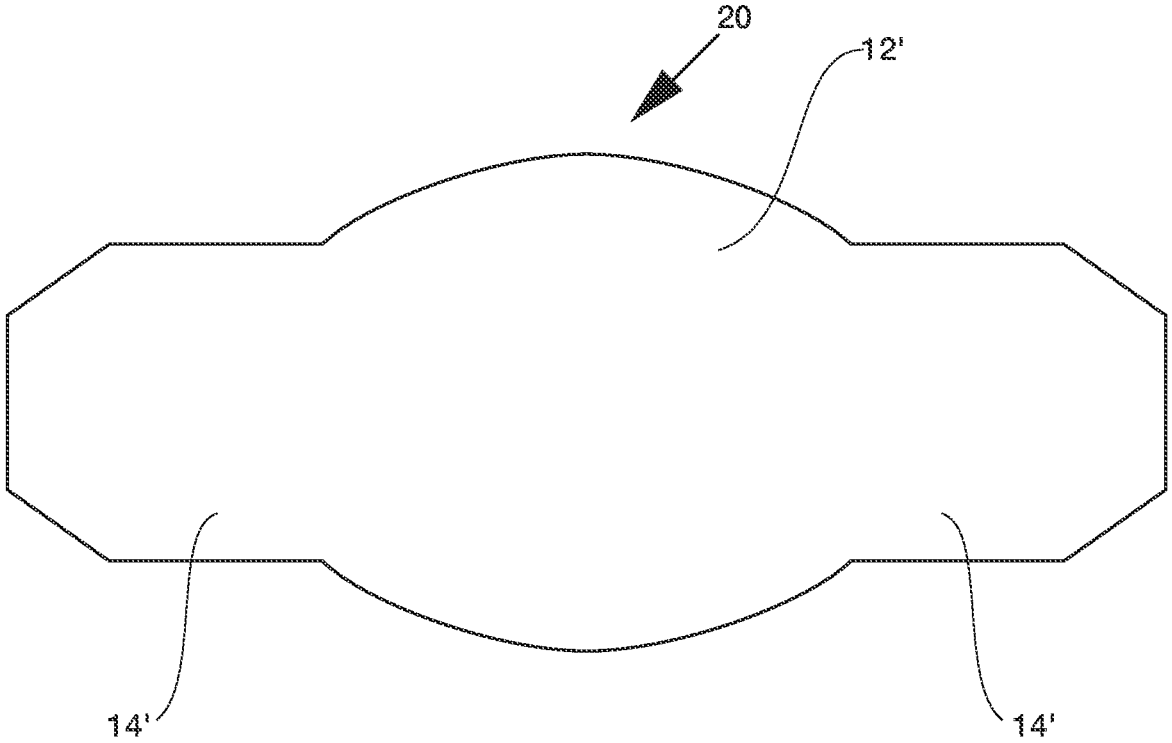
FIG. 6A is one example of an insert for a face mask according to the disclosure.
Figure 6B:
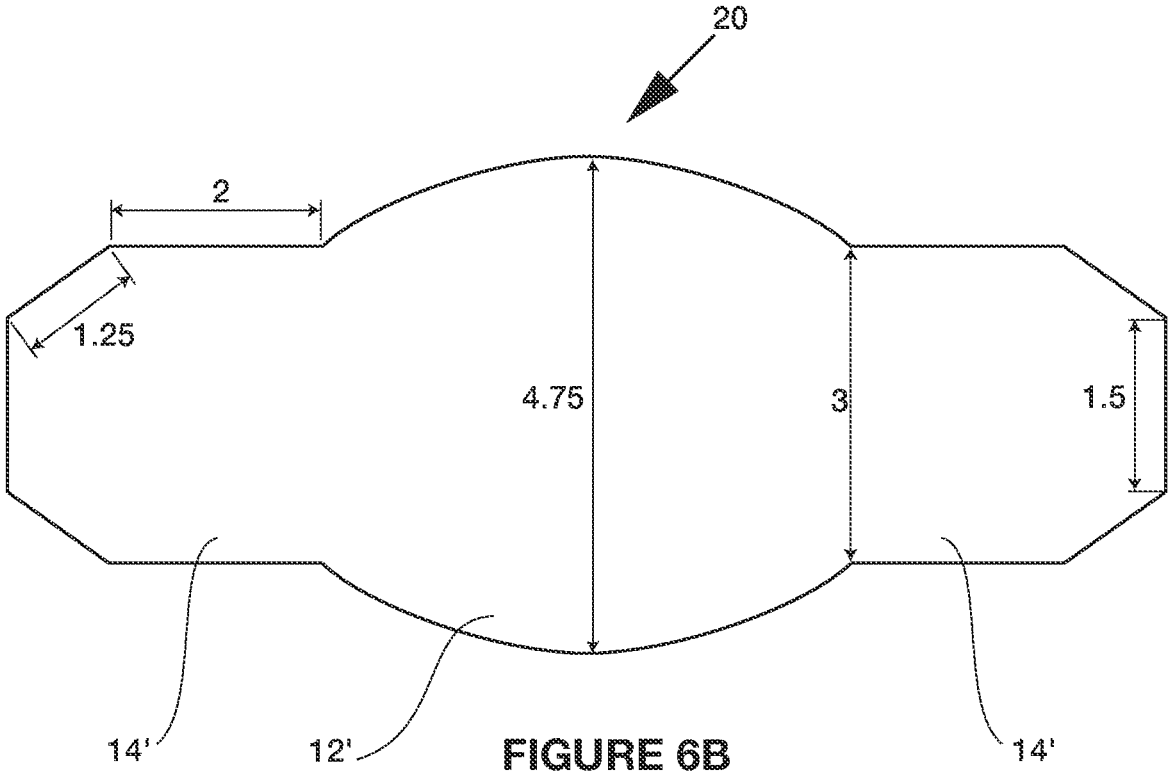
FIG. 6B shows a schematic with details of one example of the insert of FIG. 6A.
Figure 7:
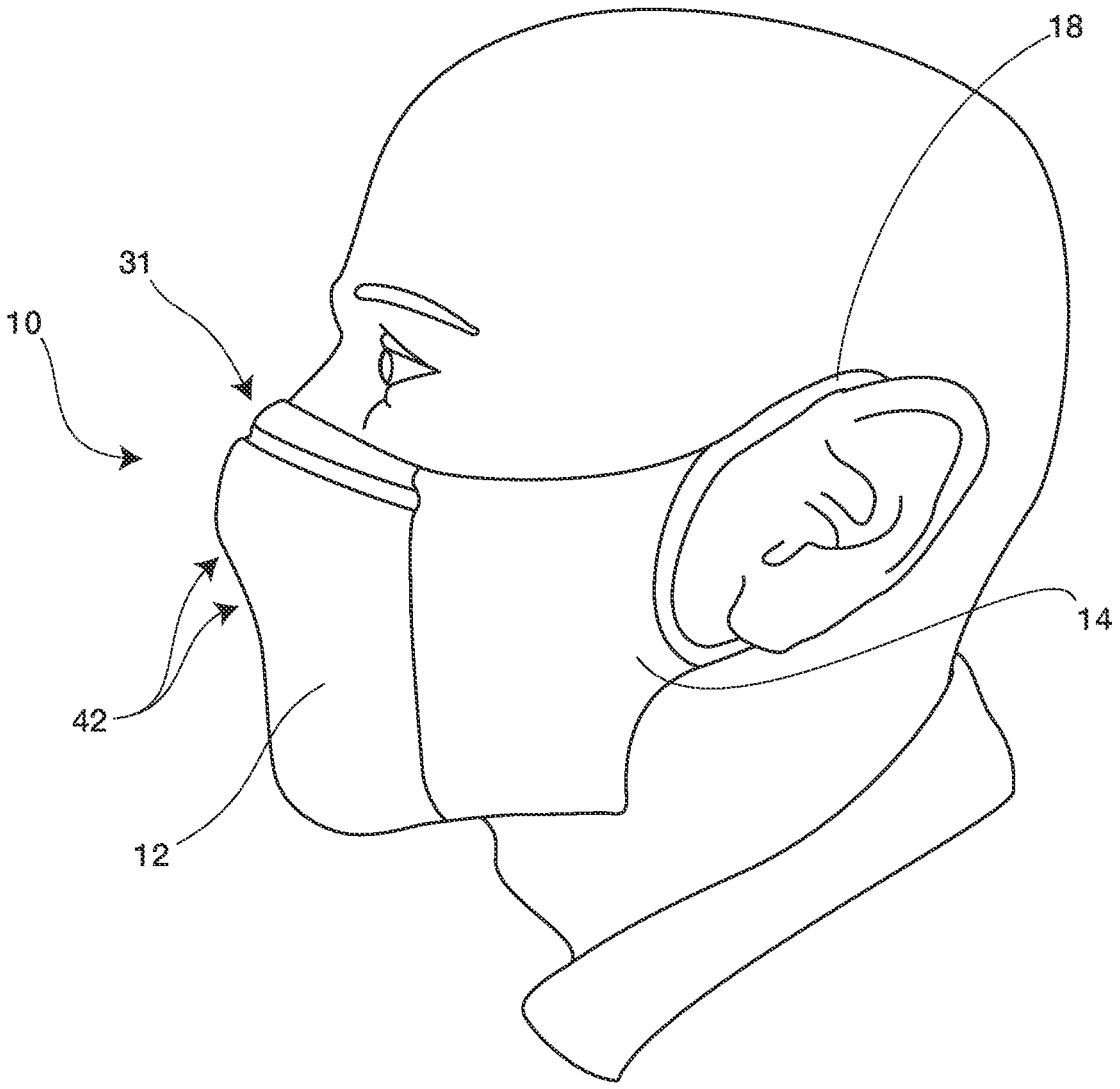
FIG. 7 shows one embodiment of a face mask in use according to the present disclosure.
Figure 8:
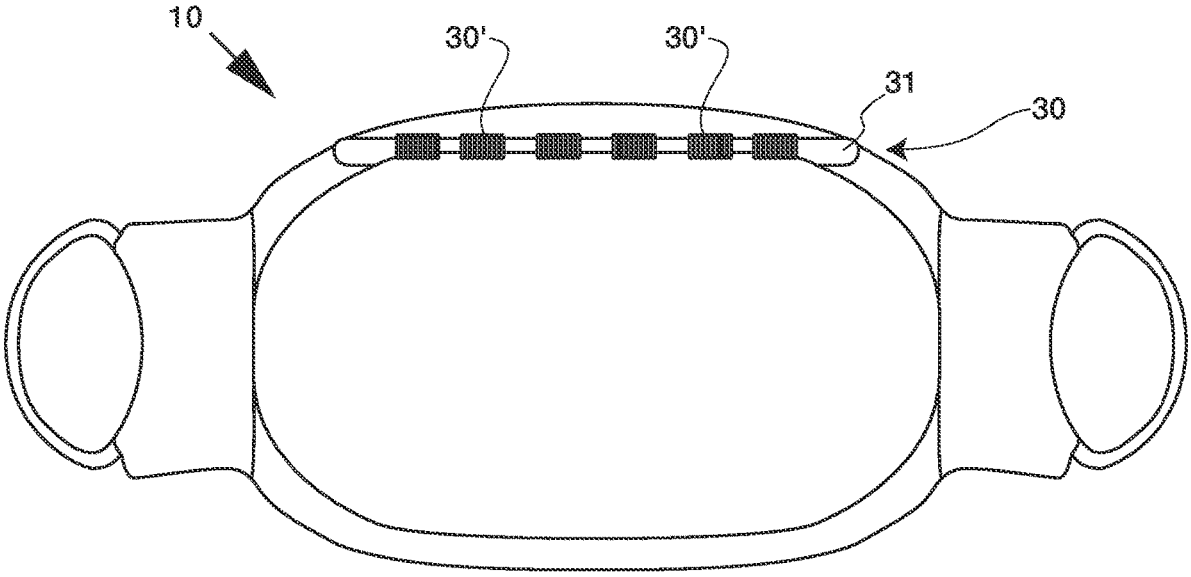
FIG. 8 shows an inside-out view of one example of a face mask according to an embodiment of the present disclosure.
Figure 9:
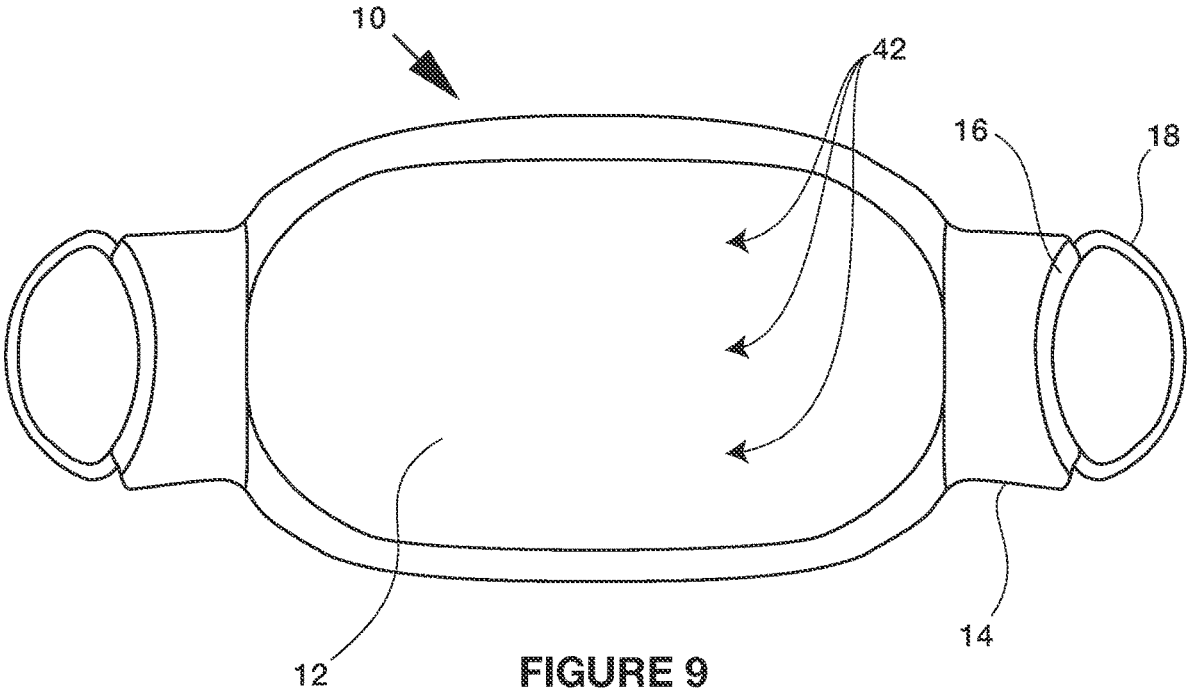
FIG. 9 shows one example of the inside surface of the face mask as shown in FIG. 8 as shown right-side out.
Figure 10:
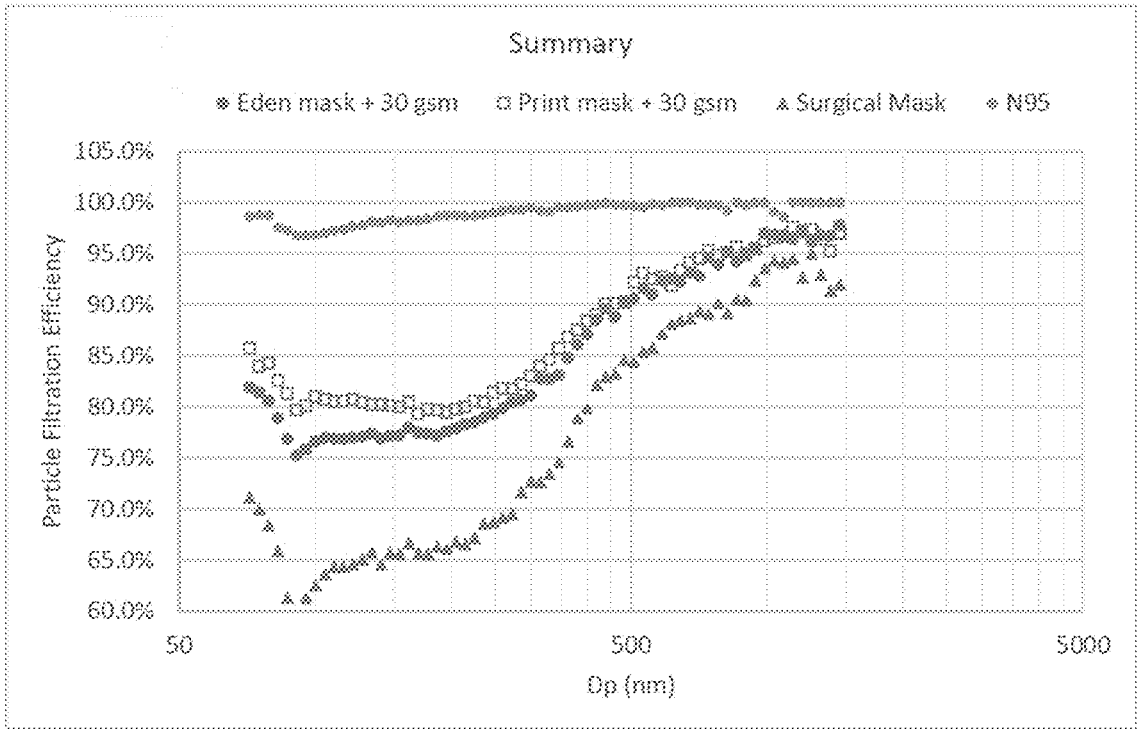
FIG. 10 shows a Table showing testing results of average sample pressure drop, particle penetration, and particle filtration in an example of the inventions.
Figure 11:
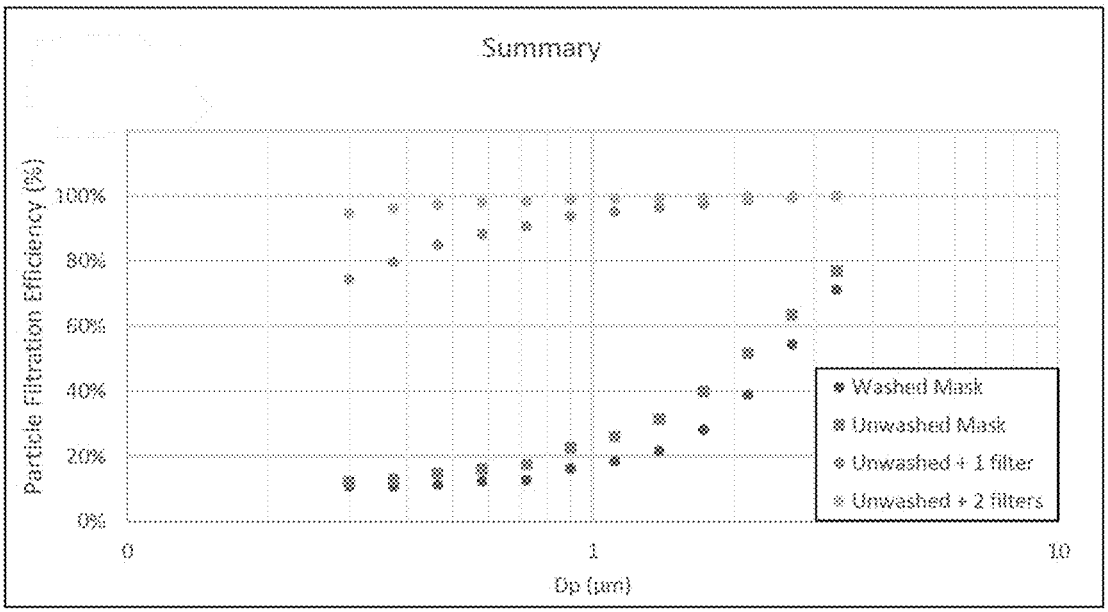
FIG. 11 shows a Table showing average particle filtration efficiency results in an example of the inventions.

As seen in an example shown in FIG. 4 of a face mask turned inside-out showing an internal side of the mask 19, a face mask 10 may include a tunnel 30 and include or accommodate a nose bridge 31. Tunnel 30 may be a continuous and/or a discontinuous tunnel. Tunnel 30 may be constructed using a nylon spandex yarn to secure the nose bridge in place in some examples. Tunnel 30 provides a pathway for a nose bridge 31 to be inserted. Nose bridge 31 may be flexible and formable. Nose bridge 31 may be removable from tunnel 30. Nose bridge 31 may be a metal nose bridge, and in some examples is fabricated from aluminum. Nose bridge 31 may include a thickness ranging from between 0.020 to 0.030 inches in some embodiments. The nose bridge 30 may include rounded corners at the nose bridge ends, and in some examples may form entirely rounded tips that aid in insertion of the nose bridge into the tunnel 30. The nose bridge may be magnetic or non-magnetic, and/or may include properties of not rusting or corroding and bending easily to a user's preferred profile. The nose bridge also may in examples not fatigue or fracture after multiple cycles of bending and be moldable to a preferred position and maintain that preferred position. By way of example, a suitable nose bridge may be made of 5052 aluminum of 0.0250 inch thickness.

In some examples, elastic thread may be incorporated into the nose bridge channel to provide a more secure fit for the nose bridge and an improved hold securing the mask in place. The nose bridge structure works with the ear loop elastic securing ends 18 to form a face mask that fits close with the face of the user without gaps between the mask and the skin to enhance breathing through the mask and not around the mask. A resting "seal' is formed at the skin-mask surface around the perimeter of the mask by way of the face mask 10 structure.

The tunnel 30 may, in some examples, be formed by bridge loops 30'. The bridge loops 30' may be spaced along the inside surface forming the tunnel 30 through which the nose bridge 31 is secured. The bridge loops 30' may be a series of bridge loops 30'. The bridge loops 30' may be a series of bridge loops 30' gathered in segments. The segments of bridge loops 30' may discontinuous in some examples.

Some embodiments may include in a tunnel 30, spun yarn (without filaments) spliced in to create the tunnel in a dimension slightly larger than the dimensions, for example the width, of a nose bridge 31 being accompanying the mask 10. Spun yarn has the advantage, as realized by applicant, of fibers tightly bundled to minimize snagging when the nose bridge 31 is inserted within the tunnel, especially upon repeated removal and replacement. In one example, a tunnel may be 7 needles wide.

Face mask 10 may include a top tuck stitch 36 and/or a bottom tuck stitch 38. A tuck stitch may be located toward a top of the mask and/or toward a bottom of the mask.

Embodiments may include where a top tuck stitch 36, a bottom tuck stitch 38 and a tunnel 30 may collectively form a pocket 42. Pocket 42 may assist in providing a breathable space around a user's nose and mouth when in use. This configuration provides a breathability to the face mask 10 not accomplished in other face masks. The knitted mask also provides for a soft face mask, especially around the user's face to avoid abrasion, provide moldabilty to the user's face and comfort for long-term wear.

A front portion 15 and back portion 17 may fold upon one another and form the dual layers of a mask 10 and create an opening in between. The tunnel 30, top tuck stitch 36 and nose bridge 31 may collectively form a nose guide area. A nose guide 40 may be stitched, marked and/or otherwise made visible to a user to denote this nose guide area.

An insert 20 may be provided. Insert 20 may be a single material or various combinations of materials to provide filtration balanced with breathability. Insert 20 may be a filter. Insert 20 may include an insert body 20' and trim ends 14' and may be in a variety of shapes, including a cylindrical body with rectangular trim ends. Insert 20 may be a non-woven insert, by way of example, a polypropylene fabric with a weight of 30 grams per square meter, with a negative electrostatic charge added to aid in filtration of smaller sized particles. When more filtration is desired, two 30 GSM inserts may be stacked together and used. A user's own filtration material may be utilized with the facial mask 10 and the opening 22 is designed to accommodate a maximum size insert to cover a maximum space within the mask, especially around the nose and mouth. The opening 22 size accommodates various size and shaped inserts easily and make replacement much simpler than in traditional masks.

In particular embodiments, the face mask 10 is washable and reusable. The two-layer mask, in examples, includes ear loops with the mask being entirely knit, avoiding cut-and-sew. This embodiment may incorporate tuck stitches to create a facial pocket for smooth profile, fit and breathability. Ear loops may be cut out from the trim to extend over half of a trim cylinder circumference to reduce puckering on the ends of the mask, which improves fit. A thermosoluble melt yarn may be used to fuse the edges of the ear loops and trim and prevent fraying, and therefore improving durability and allowing for machine washablity.

In some examples the face masks are developed on a 144-needle machine, and still in other examples on a 200-needle machine.

Testing was conducted on embodiments of the invention as disclosed herein to evaluate the efficiency of the face mask 10.

In one example, Particle Filtration Efficiency testing was performed. This procedure was performed to evaluate particle penetration of mask and material samples. Specimens were tested one at a time. Each was sealed in the test duct and subjected to a continuous aerosol challenge of polydisperse potassium chloride (KCl) particulate. The challenge aerosol was generated, dried, and then passed through a charge neutralizer before reaching the outward facing side of the test specimen. The flow rate was held constant to achieve a face velocity of 10.5 cm/s. Aerosol concentration was measured upstream and downstream of the test specimen. These measurements are used to calculate particle penetration through the specimen. Pressure drop through the test specimen is measured, which provides an indication of breathability. The challenge aerosol used was a polydisperse potassium chloride (KCl); Instrumentation was Laser Aerosol Spectrometer (TSI 3340) and Digital manometer (TSI Model 5825). Tested were examples of the invention with one polypropylene insert (Eden and Print) at 200 needle construction.

In other testing (see Table 2), efficiency of washed and unwashed face masks of the present disclosure constructed with 144-needle nylon construction was tested with and without filters. The mask specimens were tested one at a time. Samples were sealed in the test duct and subjected to a polydisperse challenge aerosol. The flow rate was controlled to achieve 10.5 cm/s face velocity. Upstream and downstream aerosol concentration and size was measured using a TSI 3030 Optical Particle Sizer. Sample pressure drop was measured using a digital manometer and monitored through each test as a test quality assurance metric. Sudden changes in pressure drop or deviations from average provide an indication of seal integrity. Other quality assurance measures are incorporated in the procedure to verify the performance of the test system include: 1) aerosol generation stability by monitoring particle counts by size over time, and orifice pressure differential; 2) particle measurement instrumentation accuracy and precision through daily testing of reference samples; and 3) candidate sample test precision by running replicate samples periodically throughout each day.

Durability and efficiency over time post wash of face masks of the present disclosure was tested by way of particle penetration and airflow resistance as specified in ASTM F3502-21(2021). A neutralized, poly-dispersed aerosol of sodium chloride (NaCl) was generated and passed through the test article. The performance of the test article was assessed by measuring the concentration of salt particles penetrating the test article compared to the challenge concentration entering the test article. The filtration performance of each test article were calculated. The airflow resistance was measured using the same method. The filter tester used in testing was a TSI® CERTITEST® Model 8130 Automated Filter Tester that is capable of efficiency measurements of up to 99.999%. It produced a particle size distribution with a count median diameter of 0.075±0.020 microns (μm) and a geometric standard deviation not exceeding 1.86 μm. The mass median diameter was approximately 0.26 μm, which is generally accepted as the most penetrating aerosol size. The entire face covering area was tested at air flow rate of 85±4 liters per minute (L/min) (Face velocity of 10±0.5 cm/s). Results indicated that filtration efficiency increases significantly after washing, face masks unwashed averaged at 15-20% PFE and ended up averaging from 40-80% PFE after 25 wash cycles.

When fitted filtration efficiency (FFE) is considered where filtration occurs while a mask is being worn by a user sitting in a chamber and breathing with movement (as outlined by the US Occupational Safety and Health Administration Quantitative Fit Testing Protocol), measurement of the percentage of particles leaking around the mask as opposed to through the mask is considered. The close-fitting face mask 10 structure minimizes breathing around the mask and encourages breathing through the mask. Face masks of the present disclosure when measured for FFE against submicron particle penetration accomplished 70% FFE or better. In some examples, face mask 10 may accomplish 74% FFE or better, and in some examples at least 79% FFE (at 0.02-0.6, median 0.5 microns).

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A dual-layer knitted face mask comprising:

a knitted front portion and a knitted back portion forming a dual layer knitted mask having an opening formed by the front portion and the back portion;

a body forming a central portion of the face mask;

a set of trim sections along each end of the body, each trim section including a welt, said welt including a laid in elastic;

a seam along each end of the set of trim sections, the seam including a thermo-soluble melt yarn integrally formed with said seam, a set of securing ends integrally knitted with the body, the securing ends forming continuous ear loops that stretch away from the mask body to encircle a user's ears for securing said face mask, a tunnel having an opening along both ends of the tunnel, wherein the tunnel extends latitudinally between the set of trim sections.

2. The mask of claim 1 wherein the mask is a continuously knitted mask.

3. The mask of claim 1 including a removable nose bridge.

4. The mask of claim 3 wherein said nose bridge is formable.

5. The mask of claim 4 including a bottom tuck stitch.

6. The mask of claim 1 wherein the mask is a no-sew mask.

7. The mask of claim 1 wherein the ear loops each form a continuous loop with extending from a front portion of the face mask.

8. The mask of claim 1 wherein the ear loops are formed from a cutout of one of the front or back knitted portions, the cutout forming an interior open space inside the ear loop.

9. The mask of claim 1 including an inside surface and an outside surface.

10. The mask of claim 9 wherein the inside surface forms the opening between the front portion and the back portion.

11. The mask of claim 10 wherein the tunnel is configured for housing a nose bridge, the tunnel formed of bridge loops spaced along the inside surface.

12. The mask of claim 11 wherein the nose bridge is removable from the tunnel.

13. The mask of claim 12 including a top tuck stitch and a bottom tuck stitch, wherein said nose bridge, said top tuck stitch and said bottom tuck stitch collectively form a pocket for forming around a user nose and for housing a user nose and mouth in breathable space.

14. The mask of claim 13 including an insert.

15. The mask of claim 14 wherein said insert is housed within said opening.

16. The mask of claim 15 wherein said insert is a removable filter.

* * * * *